United States Patent [19]

Lieu

[11] Patent Number: 4,801,284

[45] Date of Patent: Jan. 31, 1989

[54] WATER WALKING SHOES

[76] Inventor: Tam T. Lieu, 1840 Senter Rd., #3, San Jose, Calif. 95112

[21] Appl. No.: 120,961

[22] Filed: Nov. 16, 1987

[51] Int. Cl.[4] ..... A63C 15/03

[52] U.S. Cl. ..... 441/76

[58] Field of Search ..... 440/18; 441/76, 77, 441/70; 416/67, 66, 64

[56] References Cited

U.S. PATENT DOCUMENTS

| | | | |
|---|---|---|---|
| 2,651,790 | 9/1953 | Geiger | 441/76 |
| 2,933,741 | 4/1960 | Walter | 441/70 |
| 4,158,245 | 6/1979 | Cunningham | 440/18 |
| 4,530,668 | 7/1985 | Braun | 441/76 |

*Primary Examiner*—Sherman D. Basinger

*Attorney, Agent, or Firm*—Jerry T. Kearns

[57] ABSTRACT

A water walking shoe has an outer bell portion constructed from a rigid plastic material. Vent holes are spaced about the periphery of the outer bell. An inner bell is constructed from a thin plastic sheet material and is received within the outer bell. A binding for attaching the outer bell to the foot of a user has an adjustable mounting. In use, the flexible inner bell serves to open and close the vent holes in the outer bell, thus enabling air to be selectively trapped or released from within the outer bell. This overcomes the suction effect and permits the wearer to more easily lift their foot from the surface of the water while wearing these shoes. In a second embodiment, a flexible skirt attached to a lower edge of the outer bell provides an improved seal and distributes the weight of the wearer over a larger surface area, thus increasing stability.

10 Claims, 4 Drawing Sheets

WATER WALKING SHOES

BACKGROUND OF THE INVENTION

1. Field of the Invention

The present invention relates to water walking shoes, and more particularly pertains to a new and improved designed for water walking shoes. Water walking shoes known in the prior art are designed according to well known principles of physics as established centuries ago by Archimedes. These principles establish that it is necessary to provide a sufficient buoyancy to the water walking shoes to offset the weight of the wearer. In order to achieve sufficient buoyancy, conventional water walking shoes have been large bulky affairs which are difficult to manipulate properly. In one type of conventional water walking shoe, a bell in which air is trapped supports the weight of the wearer. However, the suction effect created within the bell makes it extremely difficult to lift the bell from the surface of the water to take a step. In order to overcome these difficulties, the present invention provides a water walking shoe which operates on the principle of a diving bell, trapping air within a bell shaped shell and utilizing the buoyancy of the trapped air to support the weight of a wearer. In order to allow the wearer to easily lift their foot from the surface of the water, the present invention provides a series of vent holes for venting the interior of the bell, thus allowing the suction effect to be broken.

2. DESCRIPTION OF THE PRIOR ART

Various types of water walking shoes are known in the prior art. A typical example of such a water walking shoe is to be found in U.S. Pat. No. 1,413,602, which issued to T. Michalski on Apr. 25, 1922. This patent discloses water walking shoes constructed as enclosed floats connected by a pivotal linkage. This enables one shoe at a time to be lifted from the surface of the water and advance forwardly relative to the other shoe. At this time the second shoe is then lifted from the surface of the water and advance relative to the previously advanced shoe. U.S. Pat. No. 2,651,790, which issued to L. Geiger on Sept. 15, 1953, discloses a water walking shoe which may be constructed as a double walled bell. A binding device is attached at a top portion of the bell for mounting the shoe on a wearer's foot. However, this patent does not disclose the use of any vent holes for breaking the suction effect created when the bell is placed over the surface of a body of water. U.S. Pat. No. 3,566,427, which issued to B. Davis et al on Mar. 2, 1971, discloses water walking shoes constructed as hollow floats filled with a buoyant foam material. A binding on the upper surface of the float is utilized to mount the wearer's foot. A pair of V-shaped recesses are formed on the underside of the float to provide tractional resistance against rearward movement of the float. U.S. Pat. No. 4,530,668, which issued to H. Braun on July 23, 1985, discloses a device for walking on the surface of a water comprising a series of horizontally elongated parallel keels and flaps pivotally suspended from the keels. When downward force is applied to the device in the water, the flaps pivot upwardly to form roofs of channels between adjacent keels. When the device is lifted from the water, the flaps swing downwardly, thereby breaking any suction effect which would cause retention of water within the channel. Such mode of operation improves the ease with which the device is lifted from the water in walking or skating motion. A binding is provided on the upper surface of the device for mounting a wearer's foot. U.S. Pat. No. 4,618,329, which issued to R. Celez on Oct. 21, 1986, discloses water walking shoes comprising a float assembly constructed from light buoyant materials. The float includes a binding for mounting a wearer's foot and a tail section for providing a reaction surface for pushing the shoe forwardly and a steering surface.

While the above mentioned devices are suited for their intended usage, none of these devices provide a water walking shoe constructed as a dual bell. Further, none of the foresaid devices utilize a bell shaped shell provided with vent holes for breaking the suction effect. A further feature of the present invention not contemplated by the prior art devices is the use of a flexible inner bell received within an outer bell provided with vent holes, the inner bell serving to sequentially open and close the vent holes of the outer bell. Inasmuch as the art is relatively crowded with respect to these various types of water walking shoes, it can be appreciated that there is a continuing need for and interest in improvements to such water walking shoes, and in this respect, the present invention addresses this need and interest.

SUMMARY OF THE INVENTION

In view of the foregoing disadvantages inherent in the known types of water walking shoes now present in the prior art, the present invention provides an improved water walking shoe. As such, the general purpose of the present invention, which will be described subsequently in greater detail, is to provide a new and improved water walking shoe which has all the advantages of the prior art water walking shoes and none of the disadvantages.

To attain this, representative embodiments of the concepts of the present invention are illustrated in the drawings and make use of a bell shaped outer shell constructed from a rigid plastic material and provided with vent holes. An inner bell constructed from thin flexible plastic is received within the outer bell, and in use, flexes radially to open and close the vent holes of the outer bell. An additional feature of the present invention is the provision of an adjustable binding on the outer bell for mounting a wearer's foot. In a second embodiment of the present invention, a flexible skirt is attached to the lower edge of the outer bell to provide enhanced buoyancy and stability.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention to detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of the other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water walking shoe which has all the advantages of the prior art water walking shoes and none of the disadvantages.

It is another object of the present invention to provide a new and improved water walking shoe which may be easily and efficiently manufactured and marketed.

It is a further object of the present invention to provide a new and improved water walking shoe which is of a durable and reliable construction.

An even further object of the present invention is to provide a new and improved water walking shoe which is susceptible of a low cost of manufacture with regard to both materials and labor, and which accordingly is then susceptible of low prices of sale to the consuming public, thereby making such water walking shoes economically available to the buying public.

Still yet another object of the present invention is to provide a new and improved water walking shoe which provides in the apparatuses and methods of the prior art some of the advantages therof, while simultaneously overcoming some of the disadvantages normally associated therewith.

Still another object of the present invention is to provide a new and improved water walking shoe which may be easily manipulated by a wearer striding on the surface of a body of water.

Yet another object of the present invention is to provide a new and improved water walking shoe which is constructed as an outer bell and an inner bell, with the outer bell provided with vent holes which are selectively opened and closed by flexing of the inner bell for breaking the suction effect and allowing the water walking shoes to be more easily lifted from the surface of a body of water.

Even still another object of the present invention is to provide a new and improved water walking shoe which is provided with a bell shaped shell having a flexible skirt for providing enhanced buoyancy and stability.

These together with other objects of the invention, along with the various features of novelty which charactertize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
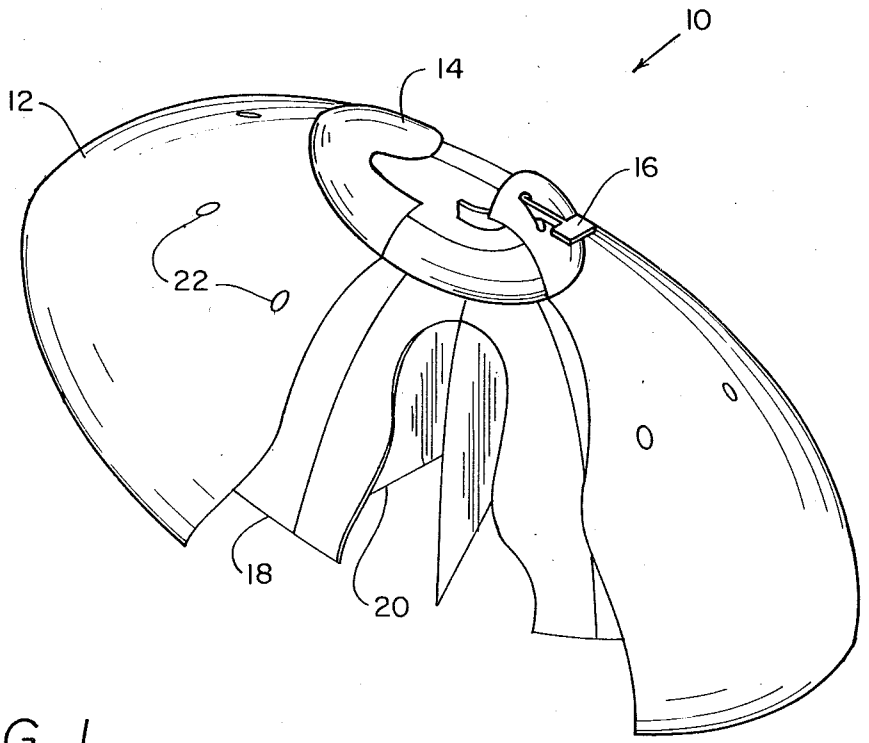
FIG. 1 is a perspective view of a water walking shoe according to a first embodiment of the present invention.

With reference now to the drawings, and in particular to FIG. 1 thereof, a new and improved water walking shoe embodying the principles and concepts of the present invention and generally designated by the reference numeral 10 will be described.

More specifically, it will be noted that the first embodiment 10 of the invention includes an outer bell shaped shell 12, preferably constructed from a rigid plastic material. The outer bell comprises a hollow oval cup-shaped shell. A binding 14 is secured to an upper surface of the outer bell 12, and is provided with an adjustable heel mounting 16. An inner bell 18, in the form of a hollow oval cup-shaped shell, is concentrically received within the outer bell 12. The inner bell 18 is divided into compartments by partitions 20. The inner bell is constructed from a thin flexible plastic material so that it may flex radially outwardly into engagement with the inner surface of the outer bell 12. A plurality of vent holes 22, formed through the outer bell 12, may thus be selectively opened or closed by virtue of the radial expansion and contraction of the inner bell 18.

Figure 2:
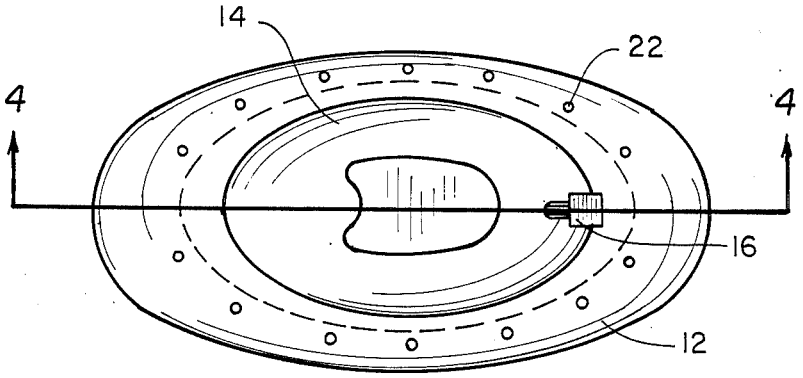
FIG. 2 is a top plan view of the water walking shoe of FIG. 1.

With reference now to FIG. 2, it may be seen that the vent holes 22 extend in the form of an oval about the periphery of the outer bell 12.

Figure 3:
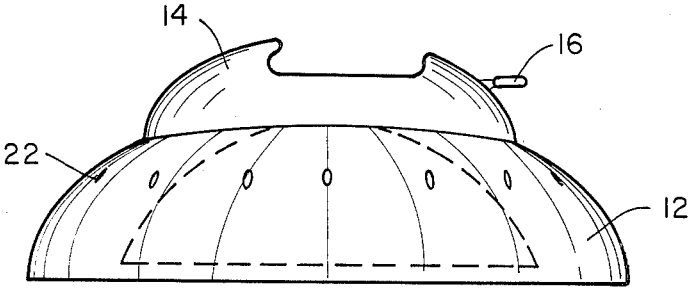
FIG. 3 is a side plan view of the water walking shoe of FIG. 1.

As shown in FIG. 3, the vent holes 22 are formed approximately one third of the height of the bell beneath the binding 14.

Figure 4:
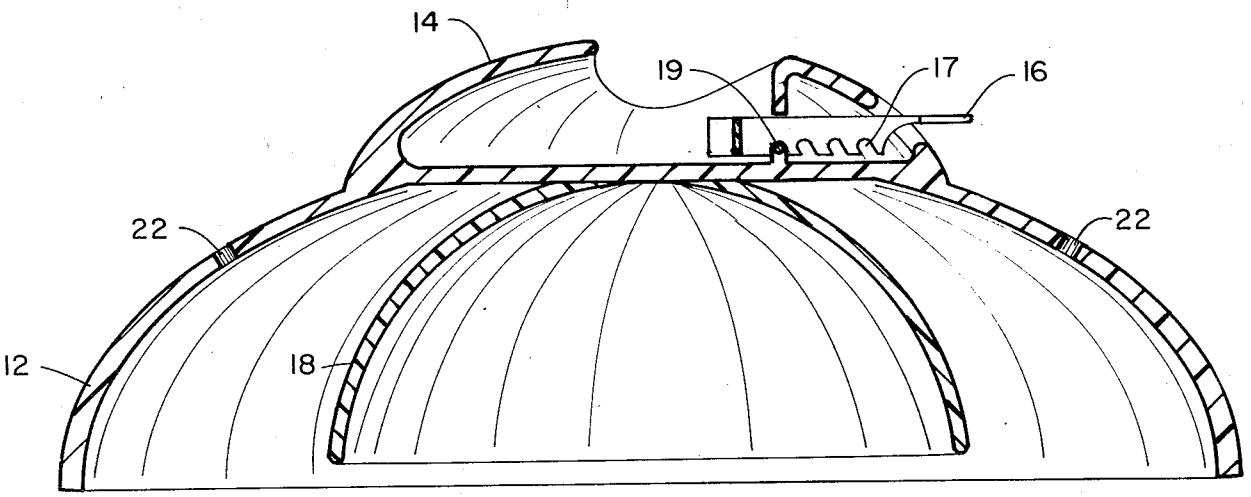
FIG. 4 is a cross sectional view of the water walking shoes of the first embodiment of the present invention taken along line 4—4 of FIG. 2.

With reference now to FIG. 4, which is a cross sectional view of the water walking shoe of the first embodiment of the present invention, it may be seen that the inner bell 18 is secured to the top inner surface of the outer bell 12, and is centrally disposed therein. It should also be noted that the bottom of the inner bell 18 is spaced vertically above the bottom of the outer bell 12. The adjustment mechanism of the binding 14 consists of an adjustable heel piece 16 which is provided with a plurality of spaced notches 17 which cooperate with a fixed pin 19. This permits the water walking shoe of the present invention to be worn by individuals having a wide variety of differently sized feet.

Figure 5:
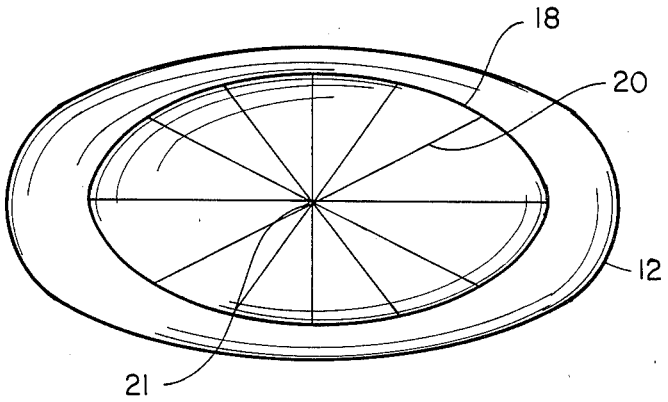
FIG. 5 is a bottom plan view of the water walking shoe of FIG. 1.

As shown by the bottom plan view of FIG. 5, the inner bell 18 is concentrically received within the outer bell 12. It should be understood that partitions 20 which extend diametrically across the inner bell 18 are split at a central point 21, thus allowing the inner bell 18 to expand radially outwardly into contact with the interior surface of the outer bell 12.

Figure 6:
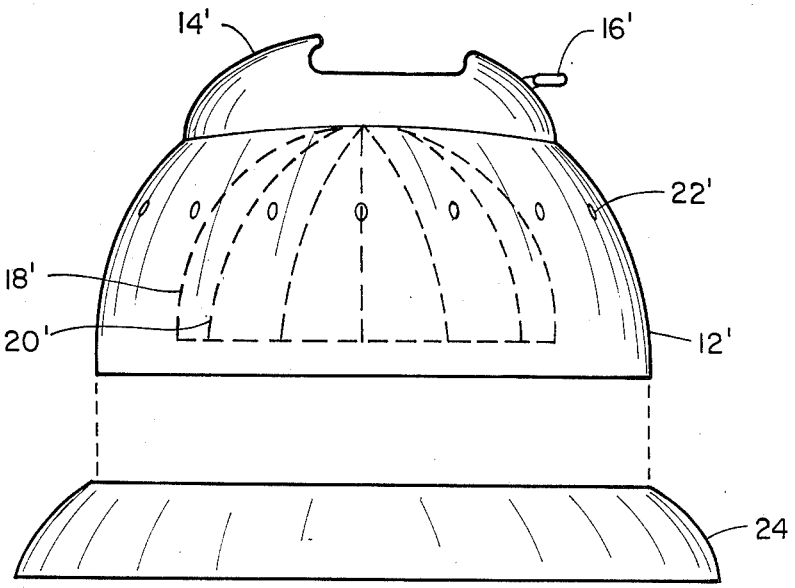
FIG. 6 is an exploded side plan view of a water walking shoe according to a second embodiment of the present invention.

As shown in FIG. 6, a second embodiment of a water walking shoe of the present invention is constructed similarly to the previously described first embodiment. An outer bell 12' is provided with a plurality of circumferentially extending vent holes 22' and is provided with a binding 14' having an adjustable heel mount 16'. A radially expandable and contractible inner bell 18' is formed from a thin flexible material and is secured to a top inner portion of the outer bell 12'. A plurality of partitions 20' divide the inner bell 18' into separate compartments. The construction of the previous elements is identical to those utilized with the first embodiment of the present invention. However, in the second embodiment of the present invention, a skirt 24 is attached circumferentially at a lower edge of the outer bell 12'. The outer bell 12', as previously mentioned, is constructed from a rigid plastic material. However, the skirt 24 is constructed from a flexible plastic or rubber material and serves to provide a superior seal to the outer bell 12', as well as to distribute the weight of a wearer over a larger surface area, thus providing enhanced stability.

With reference now to FIG. 4, the manner of usage of the water walking shoes of the present invention will now be described. A wearer first inserts their foot into the binding 14 and properly positions the adjustable heel mount 16. It should be noted that one water walking shoe of the present invention is mounted on each of the wearer's feet. The size of the outer and inner bells 12 and 18 is determined from well known physical principles depending upon the weight of the intended user. As obvious to those of ordinary skilled in the art, a heavier user will require a large size of water walking shoe in order to provide adequate buoyancy. The wearer then steps unto the surface of a body of water, the air trapped within the outer and inner bells 12 and 18 providing adequate buoyancy to maintain the wearer on the surface of the water. When it is desired to take a step, the wearer lifts the intended foot, thus taking weight off the inner top surface of the outer bell 12, causing the inner bell 18 to contract radially inwardly to the position illustrated in FIG. 4. When the shoe is again placed on the surface of the body of water, the weight of the wearer is again placed upon the top innner surface of the outer bell 12. This causes the inner bell 18 to flex radially outwardly into contact with the inner surface of the outer bell 12, thus blocking the vent holes 22 and trapping air within the outer and inner bells 12 and 18. Upon again lifting of the shoe to take another step, the inner bell 28 flexes radially inwardly, thus unblocking vent holes 22 and allowing pressure equalizatoin of the interior of the outer bell 12 with the surrounding atmosphere. This breakes the suction effect, thus allowing the water walking shoes of the present invention to be lifted from the sruface of the water with less force than that required by prior art water walking shoes.

The manner of usage of the second embodiment of the present invention is precisely analogous to that described with the first embodiment. However, the provision of the additional flexible skirt 24 provides a superior sealing effect of the air trapped within the outer bell 12' and also distributes the weight of the wearer over a larger surface area, thus providing enhanced stability.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are limited to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters patent of the United States is as follows:

1. A new and improved water walking shoe, comprising:

outer bell means formed from a rigid material;

vent means formed in said outer bell means;

inner bell means formed from a thin flexible plastic material attached to a top inner surface of said outer bell means;

binding means on a top outer surface of said outer bell means for attaching said water walking shoe to a wearer's foot; and a plurality of radially extending partitions forming compartments within said inner bell means.

2. The water walking shoe of claim 1, wherein said outer bell means is constructed from a rigid plastic material.

3. The water walking shoe of claim 1, wherein said outer bell means comprises a hollow oval cup-shaped shell.

4. The water walking shoe of claim 3, wherein said inner bell means comprises a hollow oval cup-shaped shell concentrically recieved within said outer bell means.

5. The water walking shoe of claim 1, wherein said vent means comprises a plurality of circumferentially extending vent holes formed through said outer bell means.

6. The water walking shoe of claim 1, wherein said binding means comprises an adjustable heel mounting.

7. The water walking shoe of claim 6, wherein said adjustable heel mounting includes a plurality of spaced notches cooperating with a stationary pin.

8. The water walking shoe of claim 1, further comprising flexible skirt means attached to a lower edge of said outer bell means.

9. A new and improved water walking shoe, comprising:

an oval cup-shaped outer bell constructed from a rigid plastic material;

an oval cup-shaped inner bell constructed from a thin flexible plastic material concentrically recieved within said outer bell and secured to a central interior top portion thereof;

a plurality of vent holes extending circumferentially around a periphery of said outer bell for venting the interior of said outer bell;

a binding for mounting a wearer's foot secured to an outer top portion of said outer bell;

said binding having an adjustable heel mount comprising a plurality of spaced notches cooperating with a fixed pin; and said inner bell having a plurality of radially extending partitions formed from a flexible plastic material forming a plurality of compartments.

10. The water walking shoe of claim 9, further comprising a skirt constructed from a flexible resilient material secured to a lower edge portion of said outer bell.

* * * * *